US006645087B2

(12) United States Patent
Yabu

(10) Patent No.: US 6,645,087 B2
(45) Date of Patent: Nov. 11, 2003

(54) GOLF CLUB HEAD

(75) Inventor: Masanori Yabu, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/950,738

(22) Filed: Sep. 13, 2001

(65) Prior Publication Data

US 2002/0072434 A1 Jun. 13, 2002

(30) Foreign Application Priority Data

Oct. 20, 2000 (JP) ..... 2000-321330

(51) Int. Cl.[7] ..... A63B 53/04
(52) U.S. Cl. ..... 473/342; 473/346
(58) Field of Search ..... 473/224, 234, 473/324, 329, 332, 345, 346, 349, 350, 223, 334, 282, 290, 291, 292, 342

(56) References Cited

U.S. PATENT DOCUMENTS 4,432,549 A * 2/1984 Zebelean
4,438,931 A * 3/1984 Motomiya
5,180,166 A * 1/1993 Schmidt et al.
5,240,252 A 8/1993 Schmidt et al.
5,292,129 A * 3/1994 Long et al.
5,419,559 A * 5/1995 Melanson et al.
5,908,356 A * 6/1999 Nagamoto
5,941,782 A * 8/1999 Cook
6,059,669 A * 5/2000 Pearce
6,348,013 B1 * 2/2002 Kosmatka

FOREIGN PATENT DOCUMENTS

JP A 10-33724 2/1998
JP A 10-179817 7/1998
JP A 2001-54596 2/2001

* cited by examiner

*Primary Examiner*—Sebastiano Passaniti
(74) *Attorney, Agent, or Firm*—Birch, Stewart, Kolasch & Birch, LLP

(57) ABSTRACT

A metallic golf club head is provided on the inner surface of the crown portion and/or the inner surface of the sole portion with resonance controlling lines for improving ball hitting sounds, the resonance controlling lines protrude from the inner surface and extend substantially normally to the face portion.

7 Claims, 10 Drawing Sheets

GOLF CLUB HEAD

BACKGROUND OF THE INVENTION

FIELD OF THE INVENTION

The present invention relates to a golf club head, more particularly to a hollow metallic head having an internal structure being capable of improving ball hitting sounds.

In recent years, metallic heads are widely used for various golf clubs including woods because the high performance, easy handling, controll ability and the like of the metallic heads are preferred by many golfers.

However, in case of wood club for example, metal woods, namely metallic heads are not preferred by some golfers because they feel the ball hitting sounds are poor in comparison with persimmon heads.

The present inventor therefore made researches and found out that many golfers prefer hitting sounds accompanied by a long lingering sound and feel satisfaction. To put it more concretely, it was discovered to be effective in improving hitting sounds to enhance and prolong the component of the lingering sound in a frequency band of from 4500 to 8000 Hz (wave length 75 to 42 mm), preferably 5000 to 6300 Hz (68 to 54 mm).

SUMMARY OF THE INVENTION

It is therefore an object of the present invention to provide a golf club head in which ball hitting sounds are improved by prolonging and enhancing the component of the lingering sound in a specific band by means of a simple structure without deteriorating other performance.

According to the present invention, a metallic golf club head comprises: a face portion having a ball hitting face; a crown portion; a sole portion; a cavity surrounded by the face portion, crown portion and sole portion at least; and a plurality of resonance controlling lines provided on an inner surface of one of or each of the crown portion and the sole portion which inner surface faces to the cavity, the resonance controlling lines protruding from the inner surface and extending substantially normally to an inner surface of the face portion.

DESCRIPTION OF THE PREFERRED EMBODIMENTS

Figure 1:
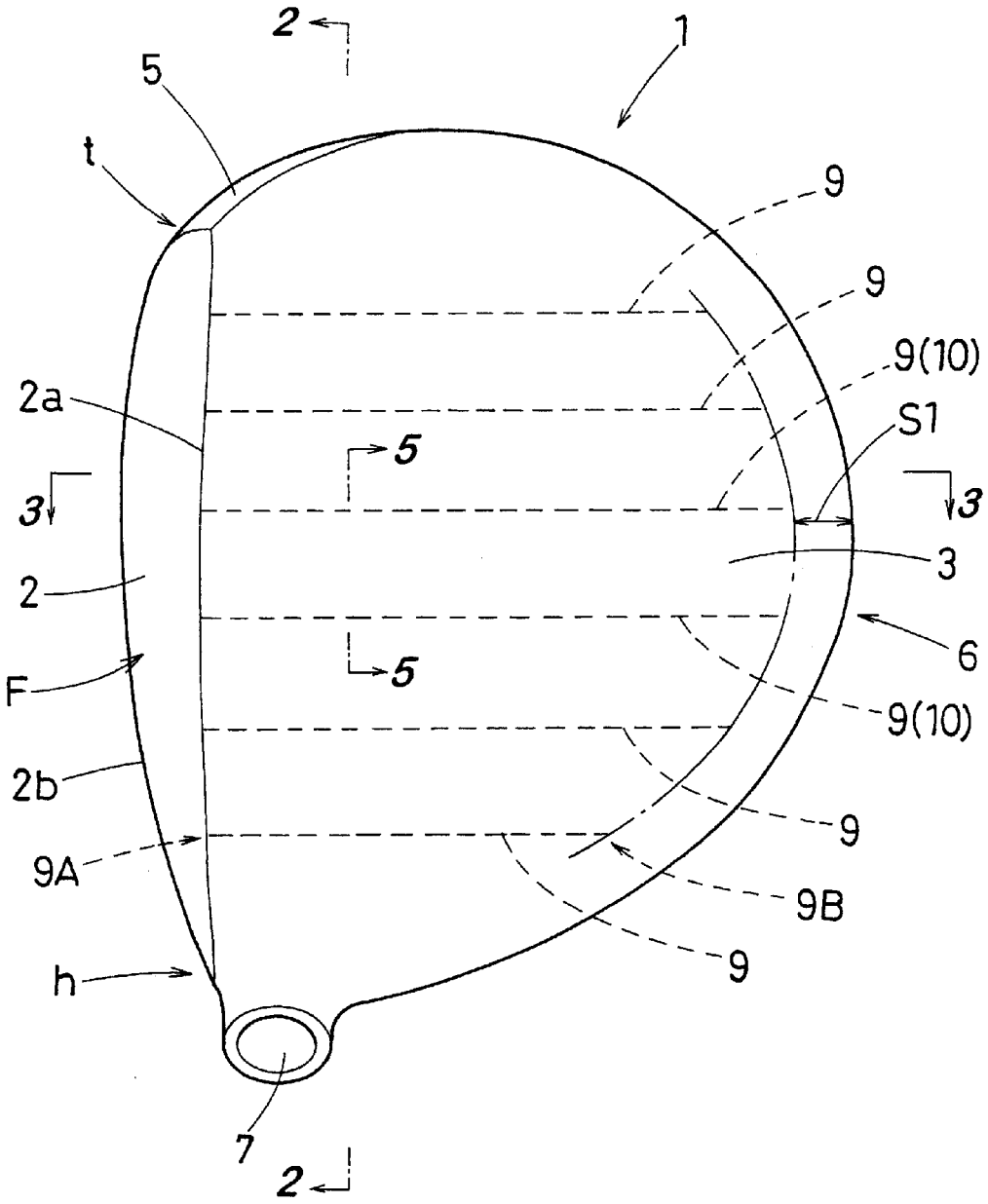
FIG. 1 is a top view of a golf club head according to the present invention.

Embodiments of the present invention will now be described in detail in conjunction with the accompanying drawings.

In the drawings, golf club head 1 according to the present invention is a wood-shaped metallic head for a wood club. The head 1 comprises: a face portion 2 defining a face for hitting a golf ball; a crown portion 3 which extends from the upper edge 2*a* of the face portion 2, defining a upper surface of the head; a sole portion 4 which extends from the lower edge 2*b* of the face portion 2, defining a bottom surface of the head; a side portion 5 between the crown portion 3 and sole portion 4 which side portion extends from the toe (t) of the face portion 2 to the heel (h) of the face portion 2 through the back face 6 of the head; and a hosel 7 having a shaft inserting hole which is formed at a heel-side intersection of the face portion 2, crown portion 3 and side portion 5. The head 1 has a substantially closed cavity (i) enclosed by the above-mentioned portions 2, 3, 4, and 5.

The club head 1 may be made by welding and/or bonding two or more metallic parts together. The metallic parts may be formed by casting, pressing, forging and the like. As the metallic materials therefor, titanium, titanium alloy, stainless steel, aluminum alloy and the like may be used. Preferably, titanium and/or titanium alloy are used for their high strength and low specific gravity.

In case of this wood-shaped head, the major part of the club head 1 including at least the crown portion 3 and side portion 5 is preferably formed as a lost-wax precision casting of a titanium alloy such as Ti-6Al-4V.

In an exemplary structure shown in FIG. 1, the head main including the crown portion 3, sole portion 4, side portion 5, hosel 7 and further a part of the face portion 2 is formed as a monolithic molding of Ti-6Al-4V by lost-wax precision casting. And the remainder of the face portion 2 is formed as a separate face plate F which is welded to the head main. As the ball hitting face of the face portion 2 is slightly bulged out as shown in FIG. 1, the face plate F is curved accordingly. For example, the face plate F can be formed by pressing a metallic plate of a titanium alloy such as Ti-15V-3Cr-3Al-3Sn. Also forging, casting and the like may be used to form the face plate aside from pressing. For example, the face plate F can be formed as a lost-wax precision casting of a titanium alloy such as Ti-6Al-4V in the same way as the head main.

Figure 2:
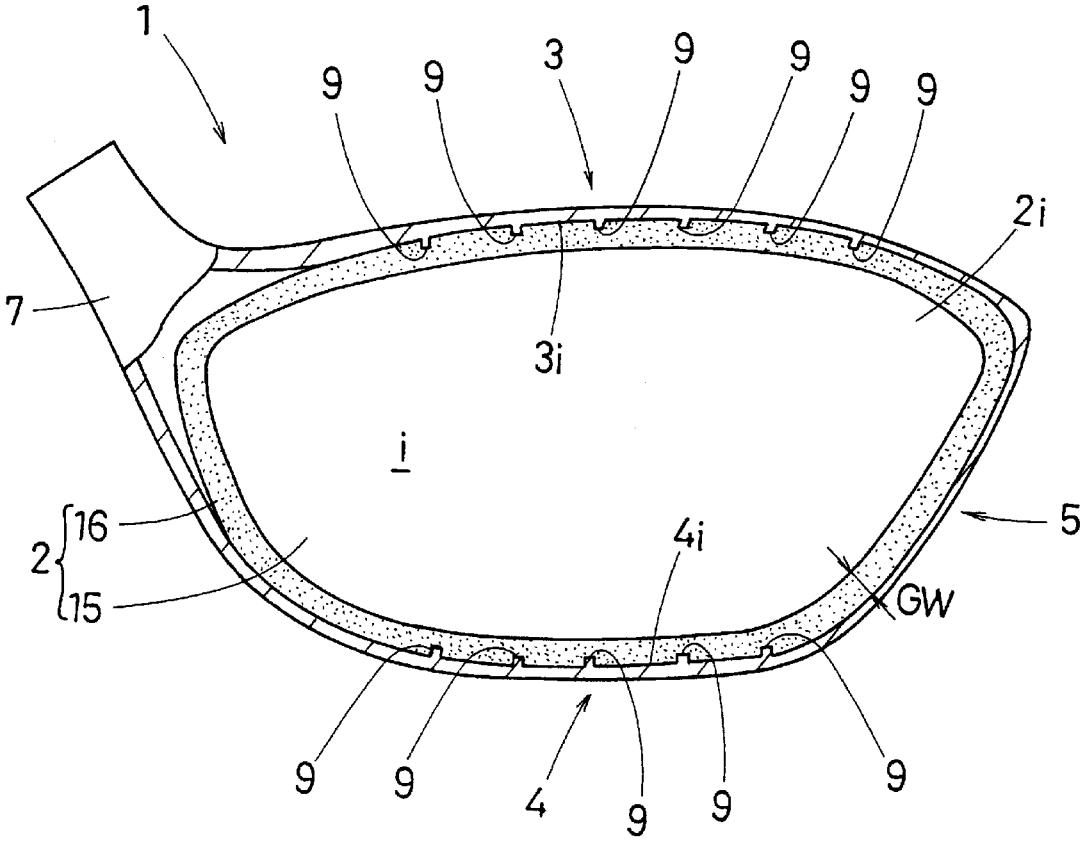
FIG. 2 is a sectional view taken along a line 2—2 in FIG. 1 showing the inner surface of the face portion.
Figure 3:
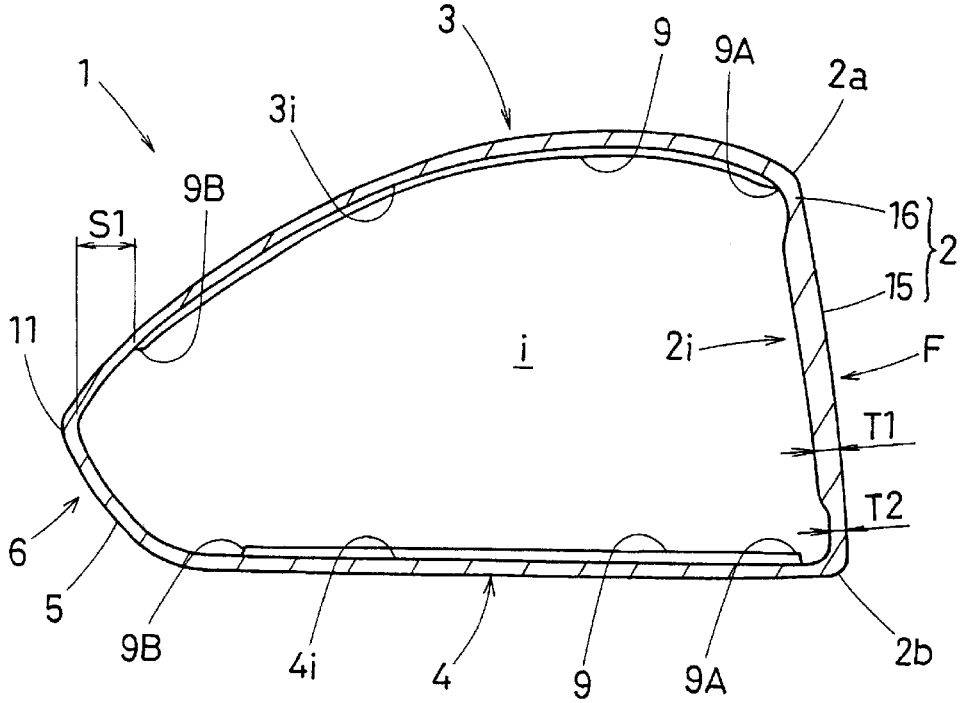
FIG. 3 is a sectional view taken along a line 3—3 in FIG. 1.

As to the face portion 2, as shown in FIG. 2 and FIG. 3, its main portion 15 which has a substantially constant thickness T1 of 2.5 to 3.5 mm, preferably 2.6 to 3.0 mm, is encircled with a groove. In other words, a thin periphery 16 is formed around the main portion 15. The thin periphery 16 has a width GW of 3 to 5 mm and a thickness T2 being less than the thickness T1, and the difference between the thicknesses T1 and T2 is not less than 0.3 mm, but not more than 0.7 mm, preferably not more than 0.5 mm. The inner surface of the face portion 2 is not supported and exposed to the cavity (i). Only the edge is supported by the shell in the crown portion, sole portion and side portion. The above-mentioned thin periphery 16 or groove is formed immediately inside such supported edge. As a result, the decay time of vibrations of the face portion 2 caused by hitting a golf ball is prolonged.

If the thickness T1 is less than 2.5 mm, the durability and strength of the face portion 2 tend to become insufficient. If the thickness T1 is more than 3.5 mm, the impact resilience of the face portion 2 tends to decrease. If the difference between the thicknesses T1 and T2 is less than 0.3 mm and/or the width GW is less than 3 mm, then it is difficult to prolong the decay time. If the thickness difference is not less than 0.7 mm and/or the width GW is not less than 5 mm, then the durability of the face portion 2 is liable to decrease.

The inner surface 3*i* of the crown portion 3 and/or the inner surface 4*i* of the sole portion 4 are provided with a plurality of resonance controlling lines 9 which extend substantially normally to the face portion 2, while facing the cavity (i). In this example, each of the portions 3 and 4 is provided with resonance controlling lines 9. It is important that the resonance controlling lines 9 extends in one direction which is substantially normal to the face portion 2, more concretely about 70 to 90 degrees with respect to the ball hitting face F.

The resonance controlling lines 9 protrude from the inner surface 3*i*, 4*i*, and the protruding height H is set in a range of 0.3 to 5 mm, preferably 0.5 to 3.0 mm.

The number of the resonance controlling lines 9 is set in a range of 2 to 10, preferably 5 to 10 per each portion 3 or 4. The intervals P of the resonance controlling lines 9 may be in a range of from 0.85 to 15.0 mm, preferably 3.0 to 15.0 mm, more preferably 3.0 to 12.0 mm.

The width W of the resonance controlling lines 9 is preferably set in a range of 0.5 to 3 mm, more preferably 1.0 to 2.0 mm.

Figure 5:
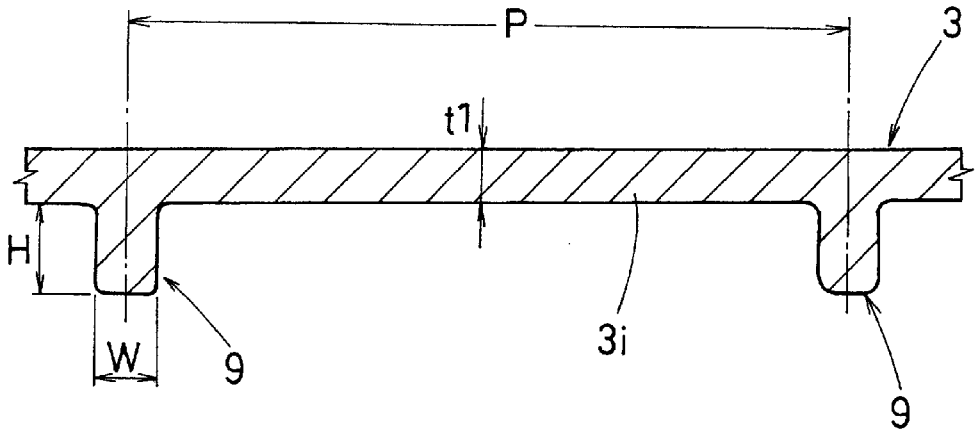
FIG. 5 is an enlarged sectional view taken along a line 5—5 in FIG. 1.
Figure 6:
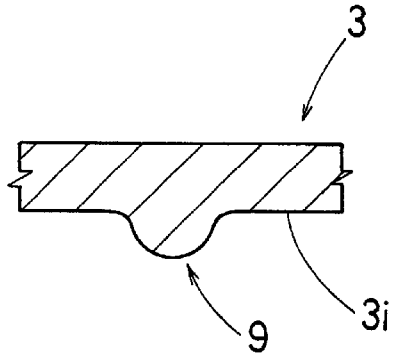
FIG. 6 and FIG. 7 are enlarged sectional views each showing another example of the cross sectional shape of the resonance controlling line.
Figure 7:
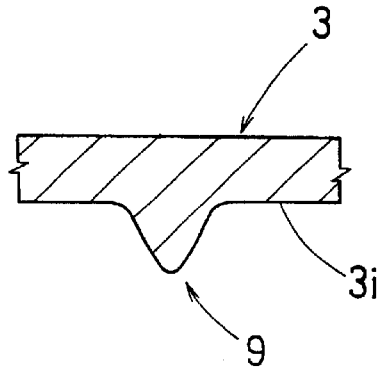

For the sectional shape of the resonance controlling line 9, various shapes, e.g. a quadrilateral whose corners are chamfered by a circular arc as shown in FIG. 5, a semicircle as shown in FIG. 6, a triangle as shown in FIG. 7 and the like may be used as far as the flow of the molten material during casting is not hindered thereby.

When hitting a golf ball, the face portion 2 vibrates and excites the air in the cavity (i) and the sound waves spread therefrom. But, the surface wave along the inner surface 3*i*, 4*i* is led towards one direction along the resonance controlling lines 9. Thus, the possibility of a standing wave in the direction of the resonance controlling lines 9 increases. Further, by setting the protruding height H relatively high, the resonance controlling lines 9 function as partitions, and the possibility of simultaneous occurrence of standing waves in different modes increases.

On the other hand, the crown portion 3 and the sole portion 4 are essentially thin enough to function as a resonant board. By providing the resonance controlling lines 9, such broad resonant board is split into narrow resonant boards. Thus, the resonant frequency shifts towards a higher band.

The resonance controlling lines 9 can promote and control various modes of resonance of the air in the cavity (i) and of the crown portion 3 and sole portion 4. As a result, the lingering sound after hitting a golf ball can be effectively increased.

The resonance controlling lines 9 each have an front end 9*a* on the face-side and an back end 9*b* on the back face side.

In order to effectively lead the surface wave, the front end 9*a* is located near the inner surface 2*i* of the face portion 2.

In case of lost-wax precision casting, the back end 9*b* is located at a certain distance from the inner surface of the side portion 5 at the back of the head. If the back end 9*b* is located near the inner surface of the side portion 5, the flow of the wax is hindered and it is unavoidable that the shape of the split core becomes complicated.

In the head shape shown in FIG. 3, the back end 9*b* of each resonance controlling line on the inner surface 3*i* of the crown portion 3 is spaced apart from an intersection 11 of the crown portion 3 and side portion 5 by a horizontal distance S1 which is not less than 5 mm and preferably not more than 15 mm.

In order to effectively increase the lingering sound in the 4500–8000 Hz band after hitting a golf ball, it is preferable that the resonance controlling lines 9 on each portion 3 or 4 include two or more adjacent resonance controlling lines 10 which have lengths L in a range of from 42 to 75 mm.

In order to avoid an unfavorable increase of the head weight and achieve the above-mentioned effects at the same time, the total volume V of the resonance controlling lines 10 is preferably limited within a range of 400 to 1200 $mm^3$, more preferably 500 to 1000 $mm^3$.

In this example, the width W, height H and sectional shape of each resonance controlling line 10 are substantially constant along its length. And the protruding height H is set in a range of from 0.5 to 3.0 times the thickness t1 of the crown portion 3.

If the rigidity of the crown portion 3 and/or sole portion 4 is excessively increased by the provision of the resonance controlling lines 9, the overall sound level of the hitting sounds is decreased, and a good lingering sound can not be obtained accordingly. Further, the resonance frequency of the crown portion 3 and/or sole portion 4 tends to increase over the above-mentioned frequency band. Therefore, the hitting sound tend to become a poor or uncomfortable sound.

Thus, the resonance controlling lines are not for increasing the rigidity of the crown portion 3 and/or sole portion 4.

Comparison Tests

Figure 4:
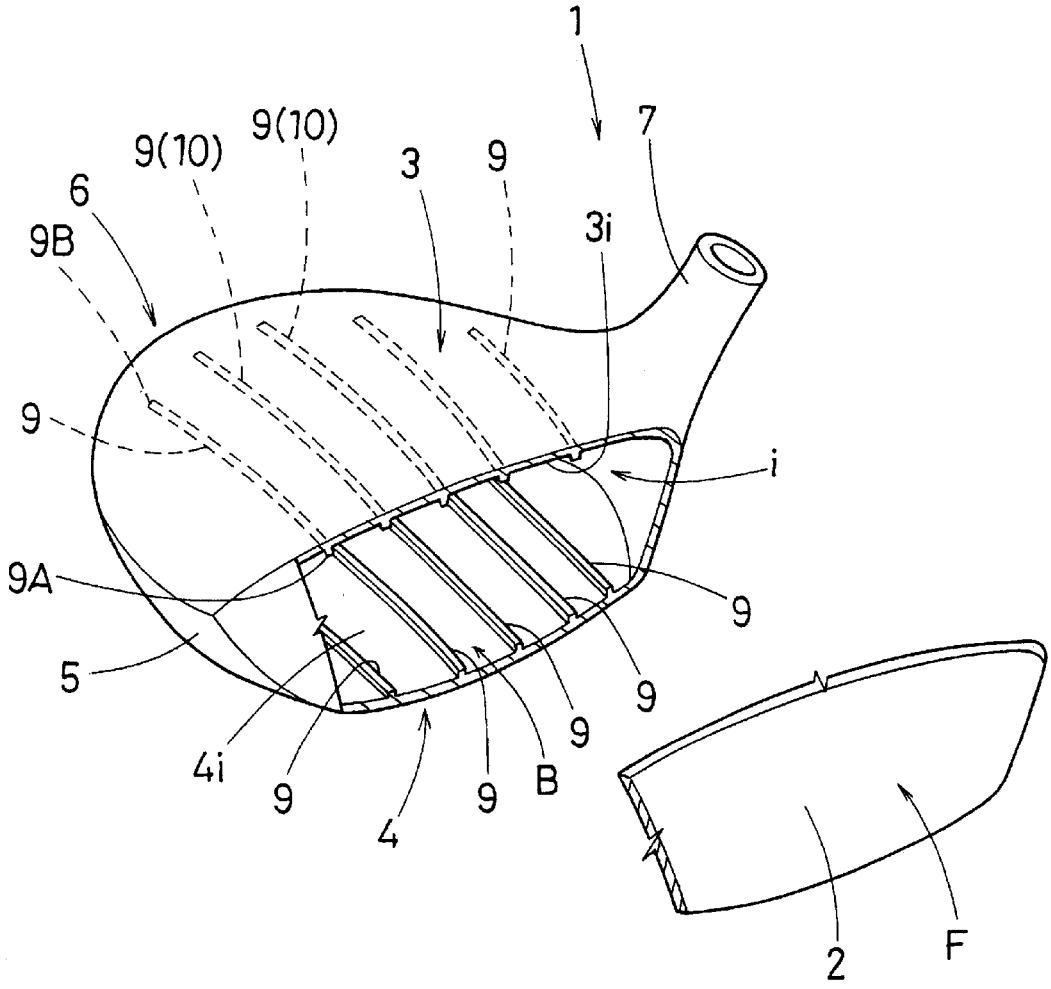
FIG. 4 is an exploded perspective view showing an example of the structure of the golf club head.

Wood-shaped golf club heads having the same structure except for the resonance controlling lines were experimentally made and tested for the hitting sound as follows. Each head was composed of a head main and a face plate as shown in FIG. 4 each formed out of a titanium alloy Ti-6Al-4V by lost-wax precision casting. The volume of the head was 320 $cm^3$. The test results and specifications of the heads are shown in Table 1.

Lingering Sound Test

Figure 12:
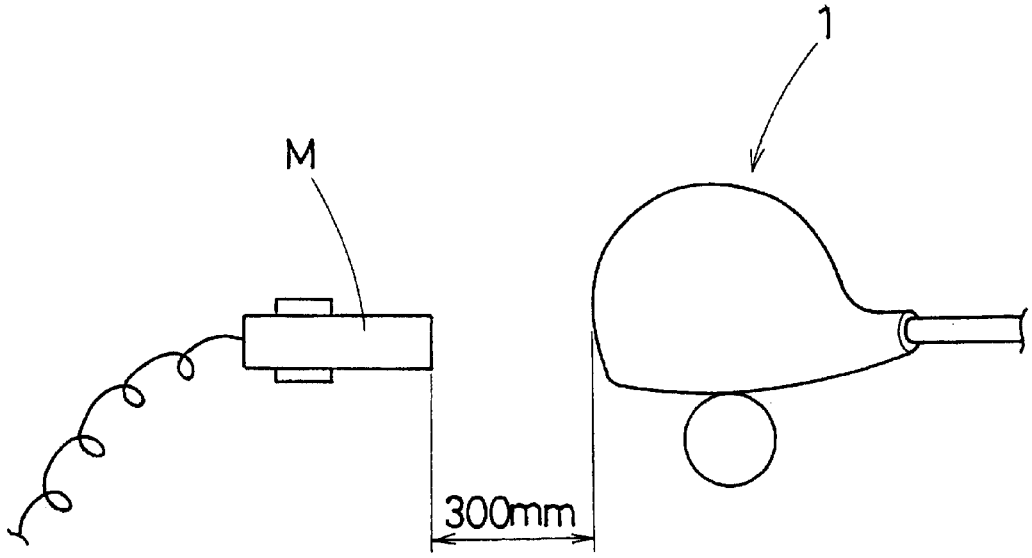
FIG. 12 is a diagram showing the relative location of a microphone for picking up a ball hitting sound.

The club heads were assembled into golf clubs. Each golf club was attached to a swing robot to hit a golf ball (MAXFLI HI-BRID, Sumitomo Rubber Ind., Ltd.) under the same conditions. Using a precision sound level meter (Rion Co. Ltd.) with a type-A curve correction filter whose a microphone M was set at a distance of 300 mm from the toe of the club head as shown in FIG. 12, the hitting sound was converted into electronic data. In order to find a peak frequency at which a maximum sound level occurred, a fast Fourier transformation and a time base analysis were made on the electronic data using a FFT analyzer (CF-6400, ONO SOKKI Co. Ltd.) under the following conditions:

Analyzing frequency range: 0 to 16 kHz

Number of sample data: 2048

Sampling time: 0 to 48 ms from the time of hitting the golf ball

Time window: Hanning window

The peak frequency and the maximum sound level were obtained by a PWR method. In Table 1, the degree of the lingering sound is shown as a quotient of the sound level after 0.04 seconds from the time of hitting, divided by the maximum sound level at the time of hitting, both at the same peak frequency.

Feeling Test

Ten golfers whose handicaps ranged from 5 to 20 evaluated the hitting sound of each club into five ranks, wherein the higher the rank number, the better the hitting sound. In Table 1, the mean values of the ten golfers are shown.

TABLE 1

Figure 8:
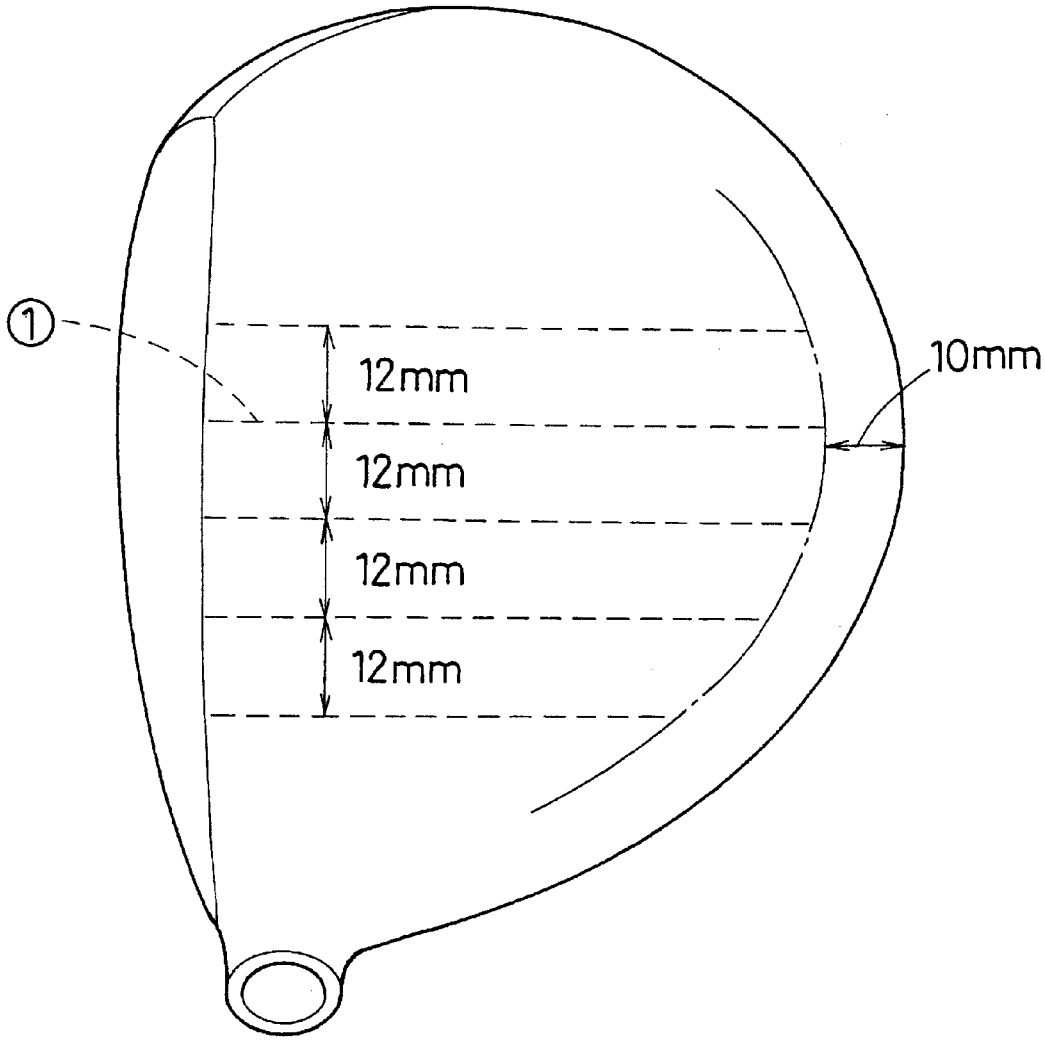
FIGS. 8–11 are diagrams showing arrangements of the resonance controlling lines employed in the undermentioned comparison test.
Figure 9:
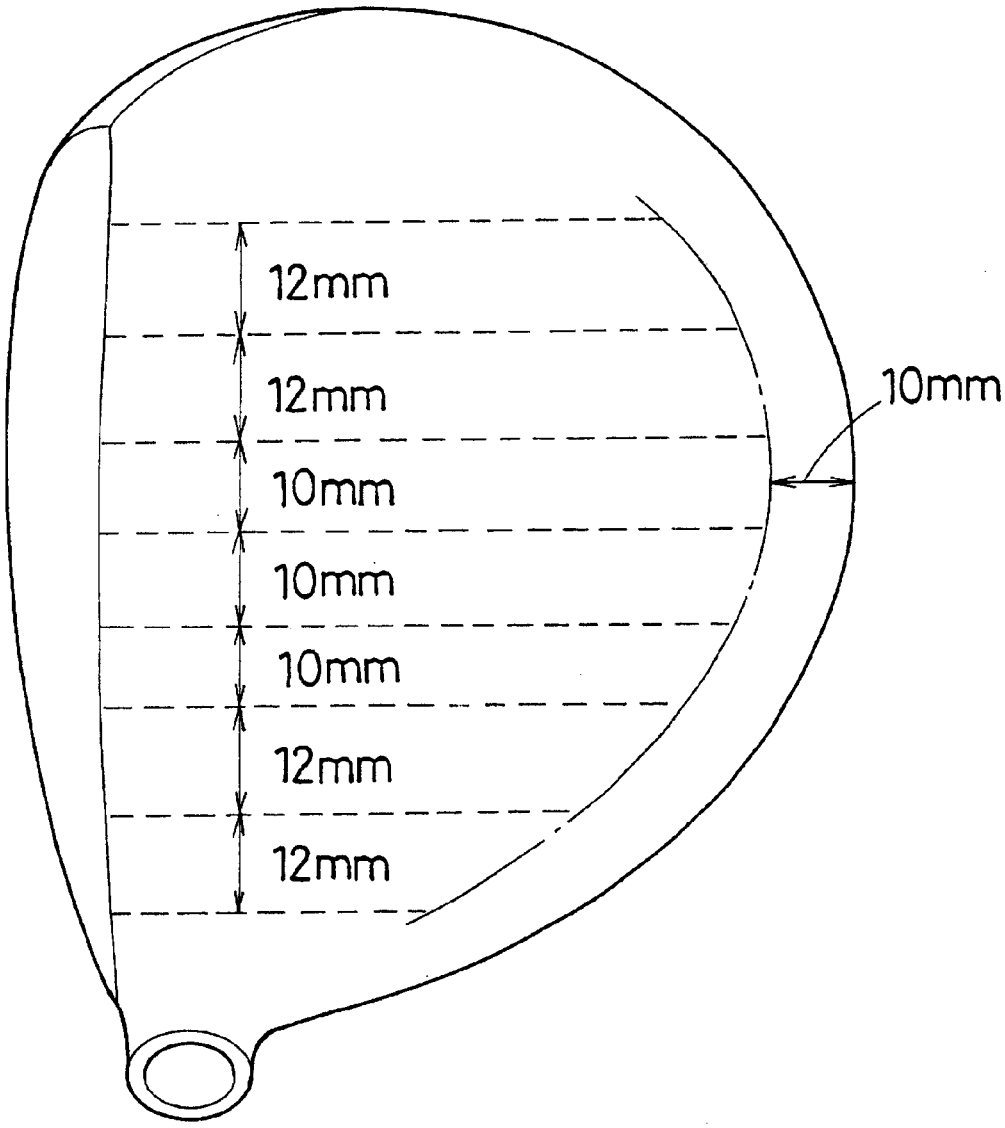
Figure 10:
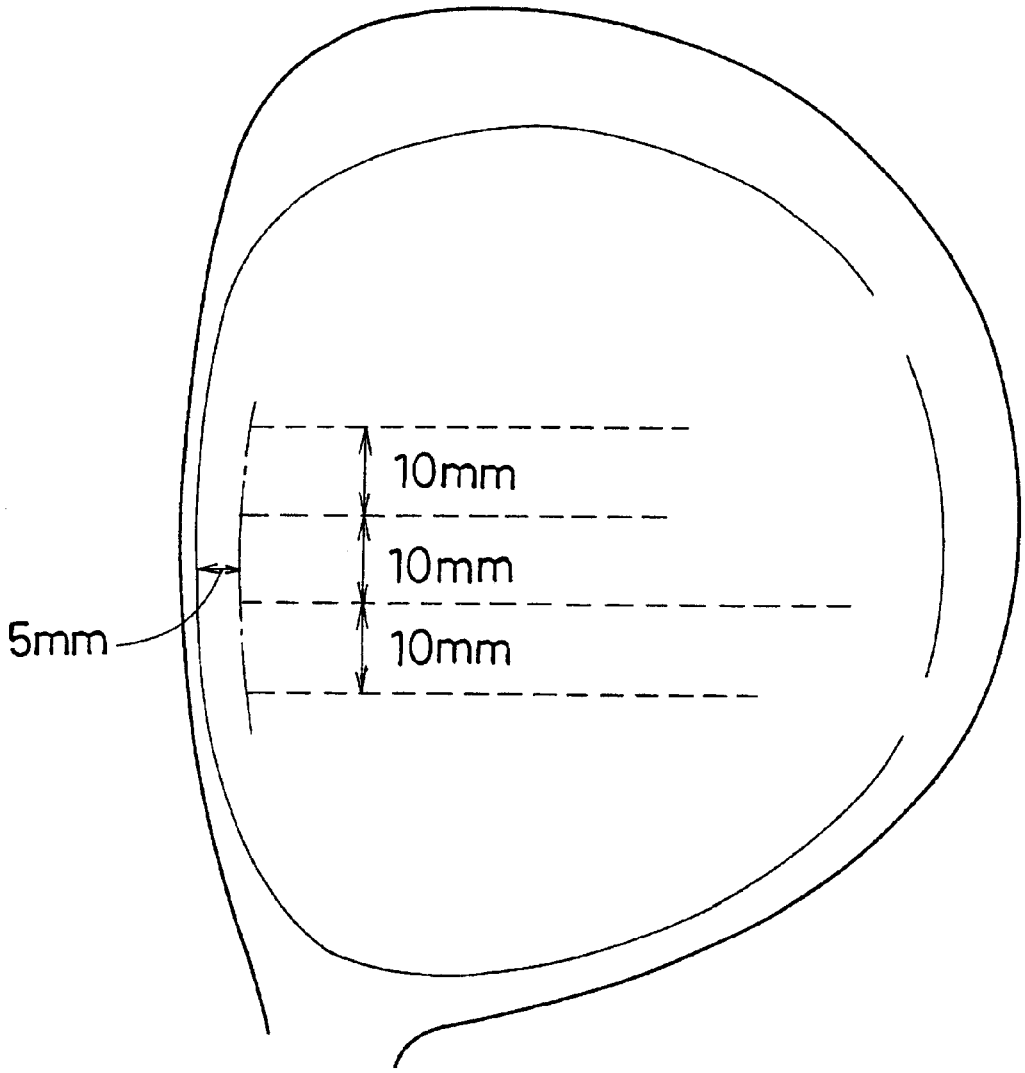
Figure 11:
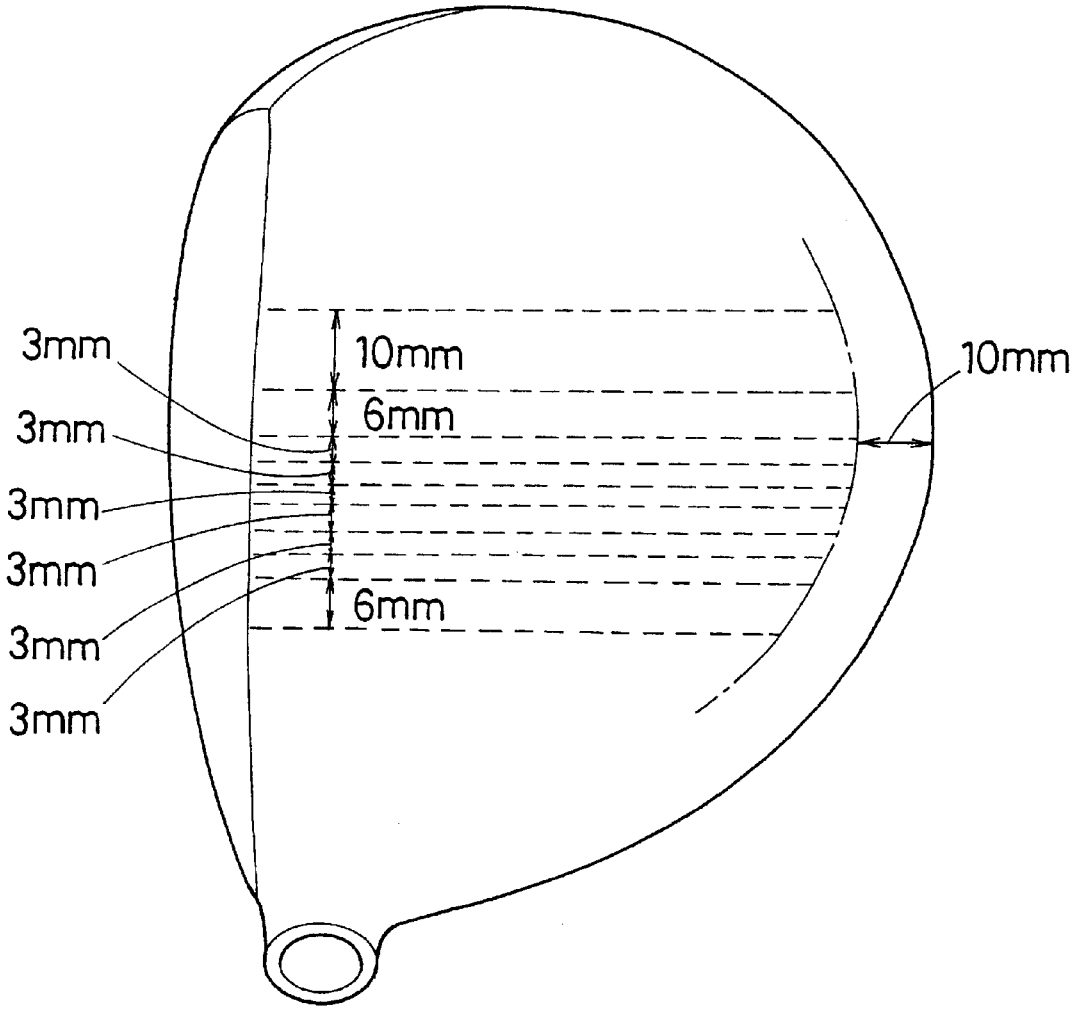

| Head | | Ex. 1 | Ex. 2 | Ex. 3 | Ex. 4 | Ref. 1 | Ref. 2 | Ex. 5 | Ref. 3 |
|---|---|---|---|---|---|---|---|---|---|
| Resonance controlling lines | | | | | | | | | |
| Number | Crown | 4 | 8 | 0 | 10 | 0 | 1 | 4 | 0 |
| | Sole | 0 | 0 | 4 | 4 | 0 | 0 | 0 | 0 |
| Arrangement | | FIG. 8 | FIG. 9 | FIG. 10 | FIGS. 10&11 | — | FIG. 8*1 | FIG. 8 | — |
| Sectional shape | | FIG. 5 | FIG. 5 | FIG. 5 | FIG. 6 | — | FIG. 5 | FIG. 5 | — |
| Width W (mm) | | 1 | 1 | 1 | 1.2 | — | 1 | 1 | — |
| Height H (mm) | | 1.5 | 1 | 1.5 | 0.5 | — | 1.5 | 1.5 | — |
| Total volume V ($mm^3$) | | 480 | 610 | 400 | 810 | 0 | 120 | 480 | 0 |
| Face portion | | | | | | | | | |
| Thickness T1 (mm) | | 3 | 3 | 3 | 3 | 3 | 3 | 3 | 3 |
| Thin periphery | | none | none | none | | none | none | | |
| Thickness T2 (mm) | | — | — | — | 2.6 | — | — | 2.6 | 2.6 |
| Width GW (mm) | | — | — | — | 4 | — | — | 4 | 4 |
| Test results | | | | | | | | | |
| Lingering sound | | 0.65 | 0.68 | 0.62 | 0.62 | 0.2 | 0.23 | 0.3 | 0.19 |
| Feeling test | | 4.5 | 4.7 | 4.1 | 4.9 | 2.2 | 2.3 | 3.2 | 2.8 |

*1 Only one resonance controlling line (1) was provided.

Form the results of the Lingering sound test and Feeling test, it was confirmed that the club heads according to the present invention can be improved in the hitting sounds. Further, through the experimental making of the golf heads, it was also confirmed that, as the structure of the resonance controlling lines is simple, the resonance controlling lines do not hinder the casting of the head, making of the mold and the like, and do not decrease the production efficiency.

The present invention can be suitably applied to the wood-shaped heads as explained above, but it is also possible to apply the invention to other kinds of hollow metallic heads, e.g. iron-shaped heads, patter-shaped heads and utility type club heads in between the wood and iron.

What is claimed is:

1. A metallic golf club head comprising:

a face portion having a ball hitting face, the face portion comprising a main part having a substantially constant thickness T1, and a thinner part around the main portion having a thickness T2 less than the thickness T1, a crown portion, a sole portion, a cavity surrounded by the face portion, crown portion and sole portion at least, and a plurality of resonance controlling lines provided on an inner surface of each of the crown portion and the sole portion which inner surface faces to the cavity, the resonance controlling lines protruding from the inner surface and extending substantially normally to an inner surface of the face portion, and all of the resonance controlling lines extending in one direction, leaving space between front ends of the resonance controlling lines and the inner surface of the face portion so as to provide no substantial support for the inner surface of the face portion.

2. The metallic golf club head according to claim 1, wherein the resonance controlling lines each have a width W of from 0.5 to 3 mm and a protruding height H of from 0.3 to 5 mm.

3. The metallic golf club head according to claim 1, wherein the total volume of the resonance controlling lines is in a range of from 400 to 1200 $mm^3$.

4. The metallic golf club head according to claim 1, wherein the pitches P of the resonance controlling lines are 0.85 to 15.0 mm.

5. The metallic golf club head according to claim 1, wherein the number of the resonance controlling lines in the crown portion per one portion, the crown portion or sole portion, is 2 to 10.

6. The metallic golf club head according to claim 1, wherein two or more of the resonance controlling lines which are adjacent to each other have lengths in a range of 42 to 75 mm.

7. The metallic golf club head according to claim 1, wherein the thickness T1 of the main part is in a range of from 2.5 to 3.5 mm, the difference between the thickness T1 and the thickness T2 of the thinner part is in a range of from 0.3 mm to 0.7 mm, and the width of the thinner part is in a range of from 3 to 5 mm.

* * * * *